US006644165B1

(12) United States Patent
King

(10) Patent No.: US 6,644,165 B1
(45) Date of Patent: Nov. 11, 2003

(54) EXPLOSION CONTAINMENT VESSEL

(75) Inventor: Kim W. King, San Antonio, TX (US)

(73) Assignee: Nabco, Inc., Pittsburgh, PA (US)

( * ) Notice: Subject to any disclaimer, the term of this patent is extended or adjusted under 35 U.S.C. 154(b) by 0 days.

(21) Appl. No.: 10/154,348

(22) Filed: May 23, 2002

(51) Int. Cl.[7] ..... F42B 39/00
(52) U.S. Cl. ..... 86/50
(58) Field of Search ..... 109/74, 84; 86/50; 220/1.6, 495.05, 560.03, 573.5, 582

(56) References Cited

U.S. PATENT DOCUMENTS

| | | | | | |
|---|---|---|---|---|---|
| 1,426,920 | A | * | 8/1922 | Sleeper | 422/241 |
| 2,936,592 | A | * | 5/1960 | Suderow | 405/208 |
| 2,940,300 | A | * | 6/1960 | Loving, Jr. | 73/35.17 |
| 3,820,435 | A | * | 6/1974 | Rogers et al. | 89/1.1 |
| 4,055,247 | A | * | 10/1977 | Benedick et al. | 206/3 |
| 4,110,173 | A | * | 8/1978 | Dix | 202/248 |
| 4,389,947 | A | | 6/1983 | King et al. | 109/1 S |
| 4,474,052 | A | * | 10/1984 | Bodurtha et al. | 73/35.17 |
| 4,589,341 | A | * | 5/1986 | Clark et al. | 102/303 |
| 4,594,513 | A | | 6/1986 | Suzuki et al. | 250/506.1 |
| 4,876,124 | A | | 10/1989 | Dallum | 428/34.5 |
| 4,889,258 | A | | 12/1989 | Yerushalmi | 220/429 |
| 5,251,473 | A | | 10/1993 | Reese | 73/49.2 |
| 5,271,493 | A | | 12/1993 | Hall | 220/469 |
| 5,601,204 | A | | 2/1997 | Hall | 220/469 |
| 5,884,569 | A | | 3/1999 | Donovan | 110/346 |
| 5,904,265 | A | | 5/1999 | Zandbergen et al. | 220/62.1 |
| 6,042,139 | A | * | 3/2000 | Knox | 280/728.3 |
| RE36,912 | E | | 10/2000 | Donovan | 110/237 |
| 6,173,662 | B1 | | 1/2001 | Donovan | 110/237 |
| 6,196,107 | B1 | | 3/2001 | Hoffman et al. | 86/50 |

* cited by examiner

*Primary Examiner*—Charles T. Jordan
*Assistant Examiner*—Bret Hayes
(74) *Attorney, Agent, or Firm*—Webb Ziesenheim Logsdon Orkin & Hanson, P.C.

(57) ABSTRACT

Disclosed is a vessel for storing explosives and containing an explosion which includes a container having a top and a bottom attached to a side wall. The container is cylindrically-shaped. The top and bottom are elliptically-shaped. A base surrounds the bottom to provide support. The top includes at least one exhaust vent. Lifts may be provided on the top of the container for lifting and transporting the vessel. A door on a side of the vessel provides access to an interior of the vessel. A door closing system secures the door during storage or an explosion. Another embodiment of the vessel further includes a liner positioned within the container, defining a gap between the liner and the container. A fragment arresting lining (i.e., sand) fills the gap. Another embodiment of the vessel further includes a layer of insulation between the container and the fragment arresting lining.

19 Claims, 7 Drawing Sheets

EXPLOSION CONTAINMENT VESSEL

BACKGROUND OF THE INVENTION

1. Field of the Invention

The present invention is directed to a storage vessel for explosives, and more particularly, to a containment vessel for storage of explosives in areas where personnel and/or inhabited buildings are present at close standoffs.

2. Description of Related Art

Explosion containment vessels are known in the art. Typical vessels are large rectangular units having an external shell and a series of reinforcements and shock absorbing material between the shells.

U.S. Pat. Nos. 6,173,662 B1; 5,884,569; and Re. 36,912 to Donovan teach an apparatus for controlling and suppressing explosions from explosive destruction of munitions by detonation in an explosion chamber, and explosion-hardening of steel work pieces. The apparatus includes a double-walled steel explosion chamber (i.e., has inner and outer casings). Ribs (I-beams) are spaced apart in the cavities between the chamber walls, ceiling, and floor for reinforcement. A fillet piece is welded in each corner to break the corner into two 45° angles.

Before use, shock-damping sand is introduced into the fillable cavities. After use, the sand is removed to lighten the chamber for transport. The floor of the chamber is covered with shock-damping pea gravel. Vaporizable plastic bags of water are disposed about the munitions and/or the chamber to further absorb energy. Vent pipes penetrate the chamber and vent explosion products into manifolds leading to a tank or scrubber. When the chamber is used to dispose of munitions, an open-topped steel fragmentation containment unit is placed within the apparatus under a steel blast mast secured to the chamber roof.

These chambers have internal dimensions that allow an operator to enter, stand up, and work easily and have a length that permits long pre-welded sections of railroad trackwork to be inserted and explosion-hardened. The chamber is anchored to a concrete foundation. Some embodiments of the chamber are mobile.

U.S. Pat. No. 5,251,473 teaches an above-ground storage tank for flammable liquids. The tank includes inner and outer welded steel tanks. A space between the tanks is filled with granular insulating material, such as perlite, to prevent excessive heating of the fuel in the inner tank. The inner tank is partitioned defining a separate overfill containment space.

A current cylindrical explosives storage vessel that can contain an accidental explosion is made by Golan and has a U.S. Department of Defense standoff rating of 30 feet. However, the door system of this apparatus permits an excessive amount of venting through the door system, resulting in possible injury to personnel standing outside of the door.

Therefore, a need exists for an explosives storage vessel that can contain an explosion, accidental or intentional, which reduces the safe standoff to a minimum distance by permitting a minimum of venting through the door system, venting being in the form of damaging overpressure and/or extreme heat and flames.

SUMMARY OF THE INVENTION

It is an object of this invention to provide an explosives storage and accidental explosion containment vessel that is rated for a design charge weight of 10 kg (22lbs) of TNT at less than 20 feet.

It is a further object of this invention to provide a vessel capable of containing an explosion within the interior of the vessel and with minimal fragment mitigation.

It is a further object of this invention to provide an explosion containment vessel that is re-usable.

The present invention is a vessel for storing explosives and containing an explosion, accidental or intentional, which includes a container having a top and a bottom attached to a side wall. Preferably, the container is generally cylindrically-shaped, and the top and the bottom are elliptically-shaped. The top preferably includes at least one vent through which products of an explosion are exhausted. Lifts may be provided on the top of the container for lifting and transporting the vessel. A door and closing system provides access to an interior of the vessel and mitigates the hazard from an explosion, resulting in a low safe standoff distance for the vessel.

Explosives may be stored in the vessel or may be detonated within the vessel without adverse affect to the environment surrounding the vessel. The vessel is rated for minimal fragment mitigation during an explosion and is capable of resisting multiple detonations of the design charge weight inside the vessel with little or no reconditioning required between explosions.

Another embodiment of the vessel further includes a liner positioned within the container, thereby defining a gap between the liner and the container. A fragment arresting lining (i.e., sand) fills the gap. After an explosion, the liner and fragment arresting lining are compromised. Therefore, the vessel in such an embodiment is not considered reusable without significant work to restore the vessel to its original condition. Yet another embodiment of the vessel includes a layer of insulation positioned between the container and the fragment arresting lining.

DETAILED DESCRIPTION OF THE PREFERRED EMBODIMENTS

Figure 1:
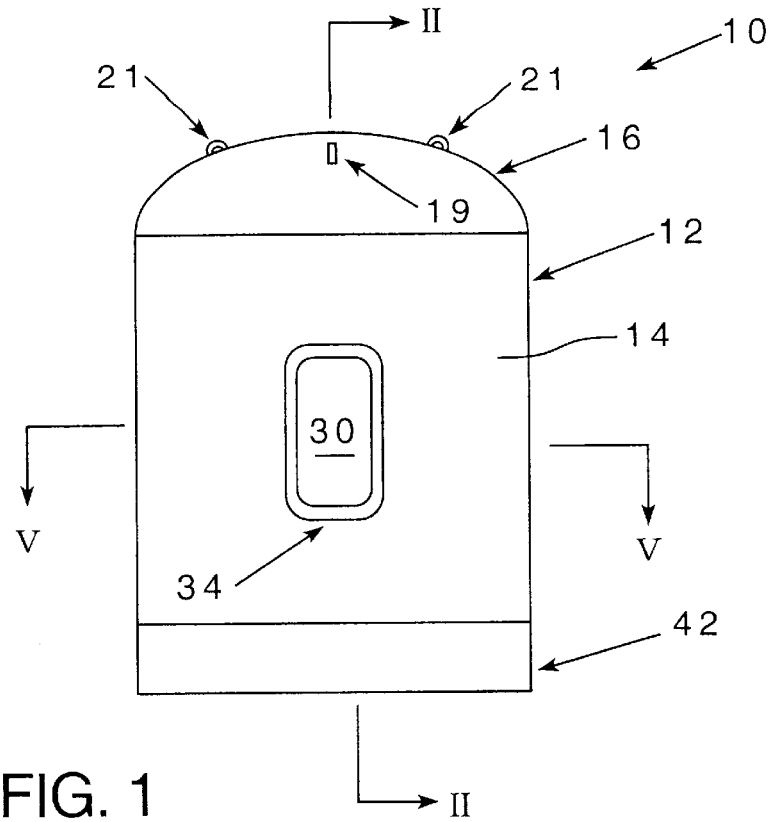
FIG. 1 is a front view of a vessel for storing explosives and containing an explosion according to the present invention.

A complete understanding of the invention will be obtained from the following description when taken in connection with the accompanying drawing figures wherein like reference characters identify like parts throughout.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
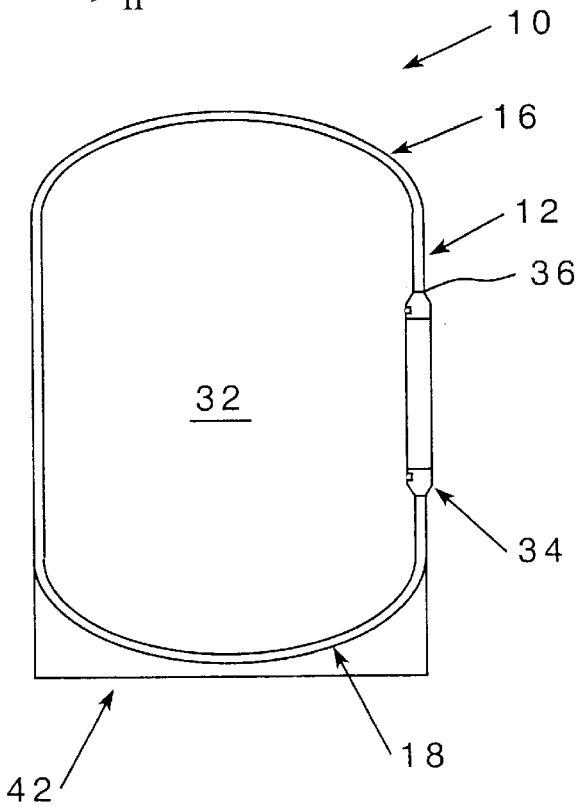
FIG. 2 is a cross-sectional view of the vessel shown in FIG. 1 along line II—II.

Referring to FIGS. 1–2, a vessel 10 for storing explosives and containing an explosion according to the present invention includes a container 12 having a side wall 14. Preferably, the container 12 is generally cylindrically-shaped. A top 16 and a bottom 18 are fixedly connected to the side wall 14 of the container 12, for example, by welding. The top 16 and the bottom 18 are preferably elliptically-shaped. The container 12, the top 16, and the bottom 18 are preferably constructed of steel having a thickness of at least about 1 inch.

The top 16 preferably includes at least one vent 19 through which products of an explosion are exhausted. The at least one vent 19 directs escaping gases upward away from an area that would be occupied by personnel. At least one lift 21, and preferably a plurality of lifts 21, may be provided on the top 16 of the container 12 for lifting and transporting the vessel 10. During use, the container 12, top 16, and bottom 18 contain the blast and any resulting fragments.

A base 42 is fixedly connected to vessel 10 at the container 12 or at the bottom 18 and surrounds the bottom 18. The base 42 is preferably steel, for example, of about 0.5 inches thick. The base 42 provides stability and support for the vessel 10 to rest upright on a surface.

Referring also to FIGS. 3–6, the vessel 10 further includes a door 30 providing access to an interior 32 of the vessel 10. The door 30 seats inside an opening support ring 34. Preferably, the door 30 and the opening support ring 34 are located near a vertical center of the vessel 10. The opening support ring 34 is positioned to cooperate with an aperture 36 in the side wall 14 of the container 12. The opening support ring 34 reinforces the side wall 14 of the container 10 and resists reaction loads against door 30 during detonations.

A ridge 31 on a face 33 of the door 30 mates with a groove 35 in the opening support ring 34 when the door 30 is in a closed position. The ridge 31 and the groove 35 correspondingly extend along a top 37, 39, a bottom 41, 43, and both sides 45, 47 of the door 30 and the opening support ring 34, respectively. During an explosion, the mating of the ridge 31 and the groove 35 interrupt the flow path for a flame front and overpressure, as well as limiting global deflections in the door 30.

Figure 3:
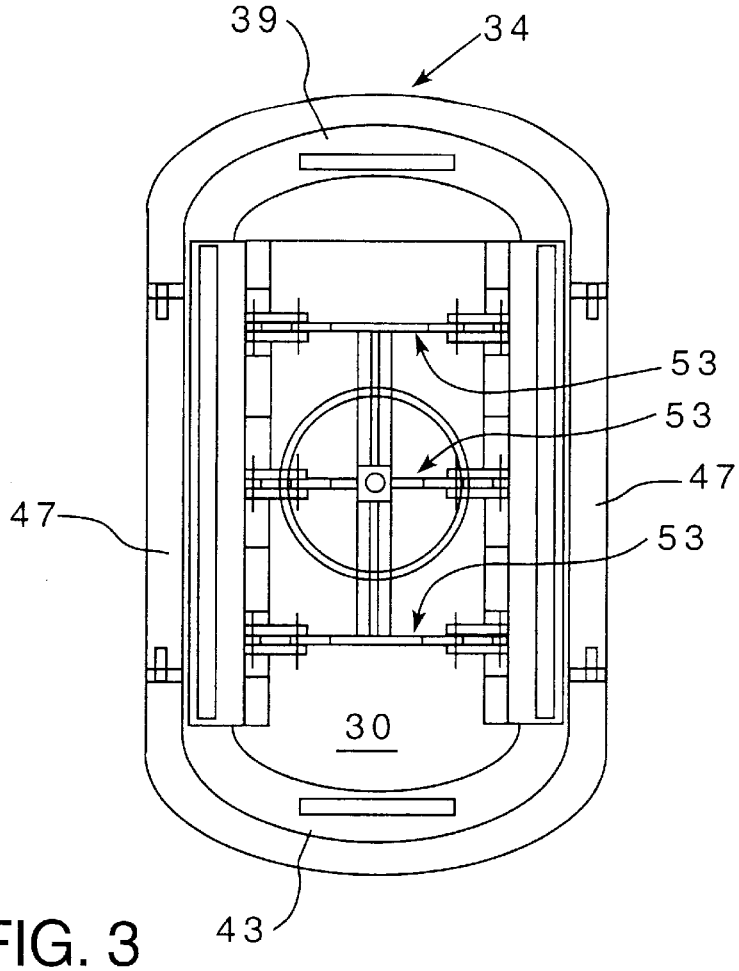
FIG. 3 is a front view of a door, an opening support ring, and a door closing system according to the present invention.
Figure 4:
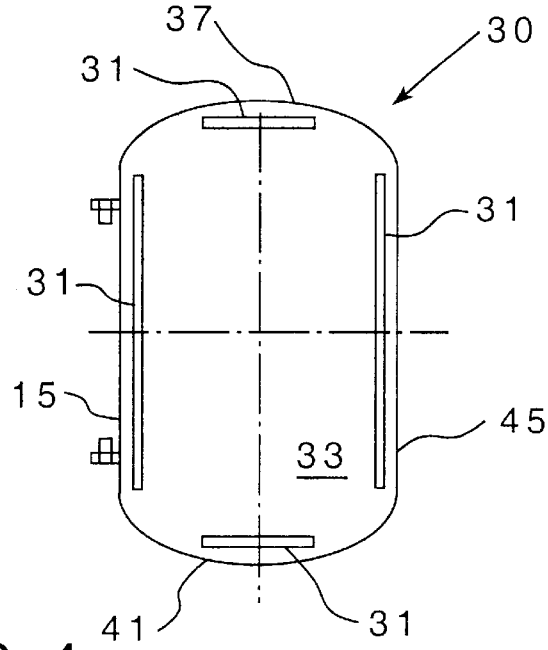
FIG. 4 is a front view of the door shown in FIG. 3.
Figure 5:
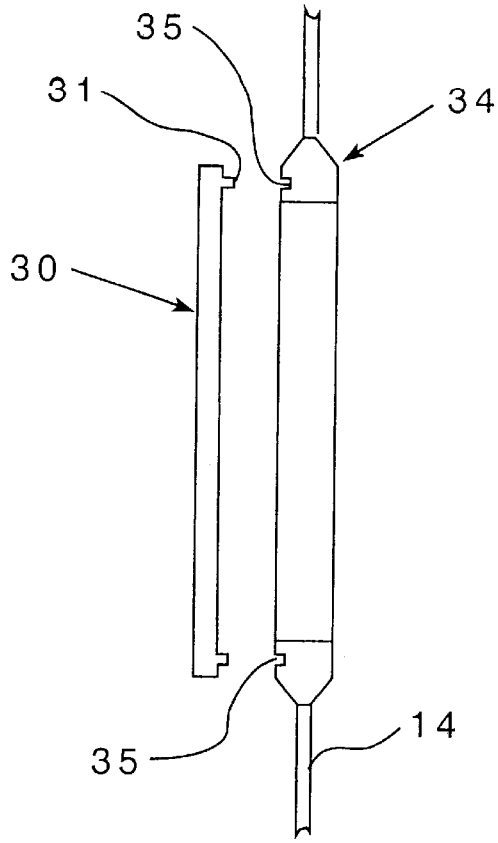
FIG. 5 is a side perspective partial view of a door, an opening support ring, and a side wall according to the present invention.
Figure 6:
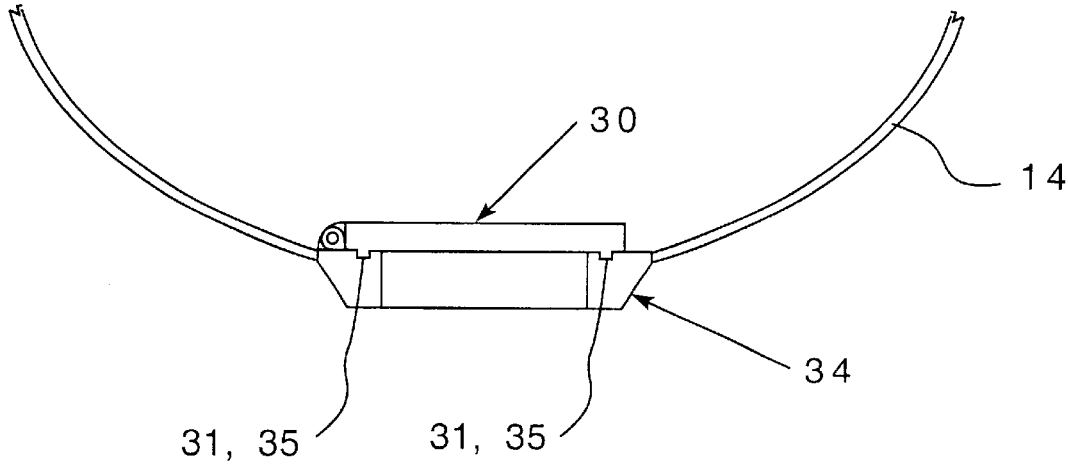
FIG. 6 is a top partial view of the door, the opening support ring, and the side wall shown in FIG. 5.
Figure 7:
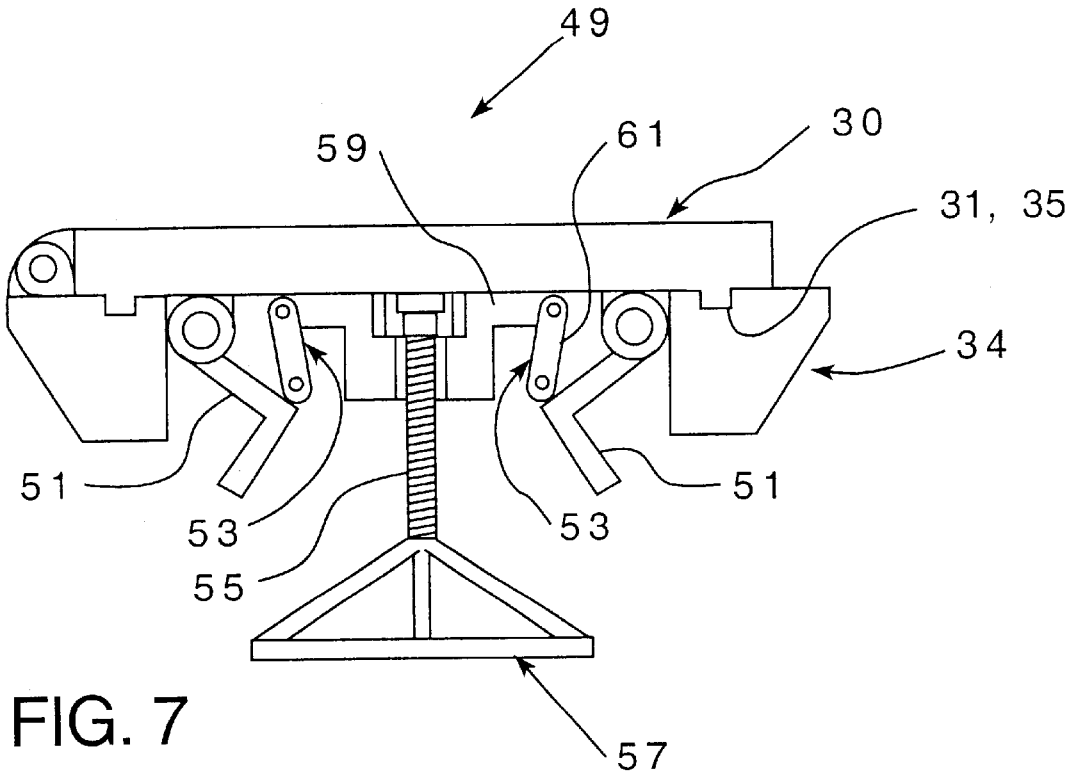
FIG. 7 is a top view of a door closing system according to the present invention in an unlocked position.
Figure 8:
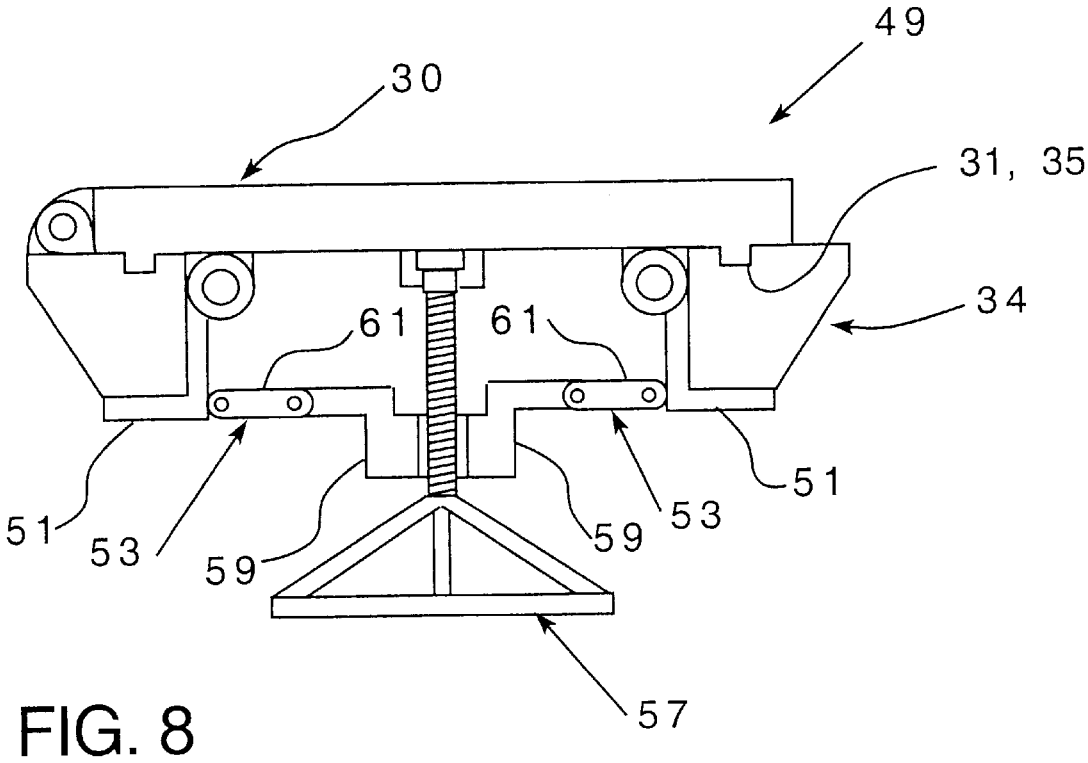
FIG. 8 is a top view of the door closing system shown in FIG. 7 in a locked position.

Referring to FIGS. 7–8, a door closing system 49 secures the door 30 inside the opening support ring 34. The door closing system includes a pair of first members 51, a plurality of second members 53, and a center pin 55. Any number of plurality of second members 53 may be provided, for example, a set of three second members 53, as shown in FIG. 3. The center pin 55 may have a handle 57 attached to an end thereof. The pair of first members 51 cooperates with the plurality of second members 53, for example, pivotally. The center pin 55 cooperates with the plurality of second members 53 to actuate the door closing system 49. For example, the center pin 55 and the plurality of second members 53 may be correspondingly threaded for engagement with and movement relative to each other.

Preferably, the plurality of second members 53 cooperate with a stationary member 59 and a plurality of pivot members 61. The stationary member is threadedly engaged with the center pin 55 at one end and cooperates with the pivot members 61 at the other end. The pivot member 61 pivotally cooperates with the stationary member 59 at one end and one of the pair of first members 51 at an other end. Preferably, each of the pair of first members 51 is L-shaped and cooperates with a pivot member 61 at the comer of the L-shape.

To secure the door 30 using the door closing system 49 with the threaded center pin 55 and plurality of second members 53, the door closing system 49 starts in an unlocked position as shown in FIG. 7. The center pin 55 is rotated, for example, by turning handle 57. The cooperating engagement of the threads of the plurality of second members 53 with the threads of the center pin 55 cause the plurality of second members 53 to travel lengthwise along the center pin 55. As the plurality of second members 53 moves, the pair of first members 51 pivots accordingly. When a locked position is reached, as shown in FIG. 8, the pair of first members 51 engage the opening support ring 34 (i.e., the "L" wraps around a "corner" of the opening support ring 34), which firmly secures ridge 31 in groove 35. To unlock the door closing system 49, the center pin 55 is rotated in the opposite direction until the unlocked position is reached.

When the plurality of second members 53 are locked into position, the door 30 is completely restrained along the full length on both sides 45, 45. This is more effective than restraining the door 30 at the top 37 and the bottom 41 because the aspect ratio of the height of the door 30 to the width of the door 30 causes it to structurally span from side 45 to side 45 (i.e., the short direction). By clamping the door 30 along the sides 45, 45, as opposed to discrete locations along the sides 45, 45 or one central location such as the center of the door 30, the door 30 is not allowed to separate from the opening support ring 34 significantly during an explosion. By limiting separation between the door 30 and the opening support ring 34, the overpressure and the flame front are suppressed more efficiently.

Figure 9:
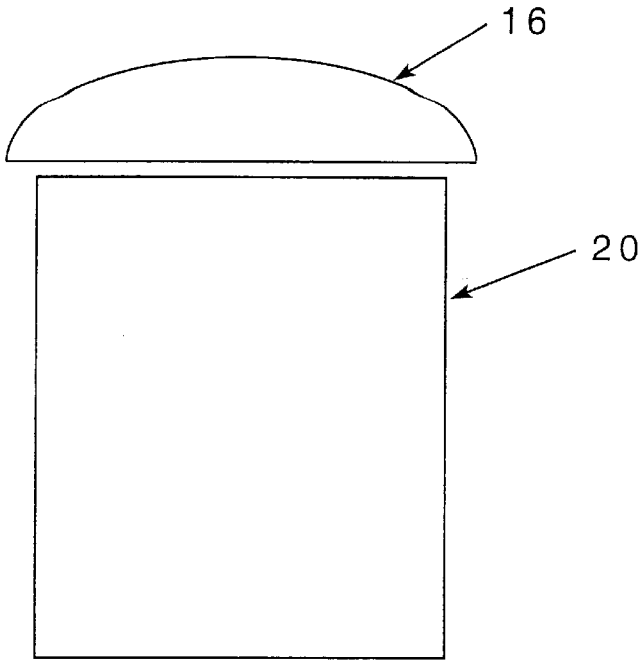
FIG. 9 is a front partial view of a container and a liner of the vessel shown in FIG. 1.
Figure 10:
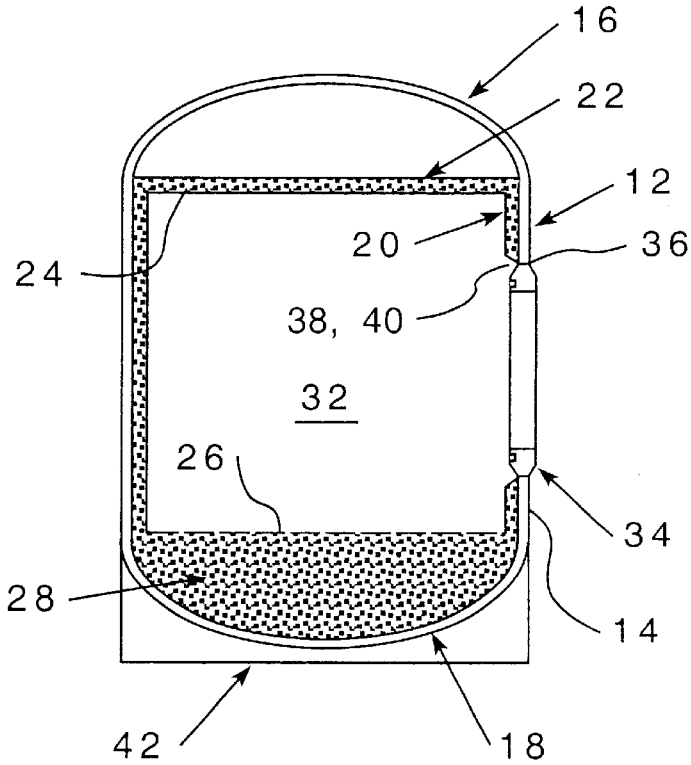
FIG. 10 is a cross-sectional view of the vessel shown in FIG. 1 along line II—II showing features of an alternate embodiment.
Figure 11:
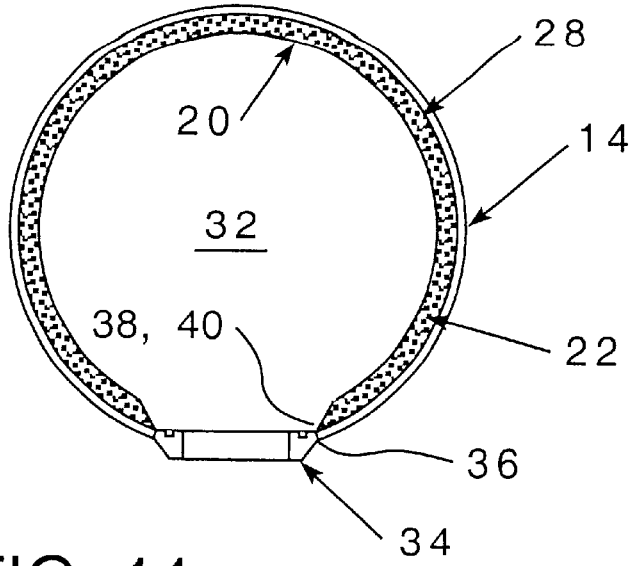
FIG. 11 is a cross-sectional view of the vessel shown in FIG. 1 along line V—V showing features of an alternate embodiment of FIG. 10.

Referring to FIGS. 9–11, in another embodiment of the vessel 10 according to the present invention, the vessel 10 may further include a liner 20 positioned within the container 12, thereby defining a gap 22 between the liner 20 and the container 12. The liner 2 may be a light gauge metal, such as steel, and preferably has a thickness of about ⅛ inch. The liner 20 is generally cylindrical in shape with a top 24 and bottom 26. Preferably, the top 24 and bottom 26 are generally flat. However, the liner 20 may have no bottom 26. The liner 20 and the fragment arresting lining 28 include apertures 38, 40 corresponding to the aperture 36 in the side wall 14. The liner 20 may have angle braces cross-welded on an inside or the top 24 to provide further structural stability. The liner 20 may be configured to overlap with the bottom 18 of the container 12, for example, to provide approximately a 3 inch overlap.

A fragment arresting lining 28 is positioned within the gap 22. The fragment arresting lining 28 is preferably a volume of sand filling the gap 22 between the liner 20 and the container 12. For example, approximately four (4) inches of sand may surround the entire space between the liner 20 and the container 12 (i.e., fill the gap 22). The sand may fill only a portion of the gap 22 between the top 24 of the liner 20 and the top 16 of the container 12. In this configuration, during use, the sand mitigates the blast fragment effects and the container 12 contains the blast and fragments.

Figure 12:
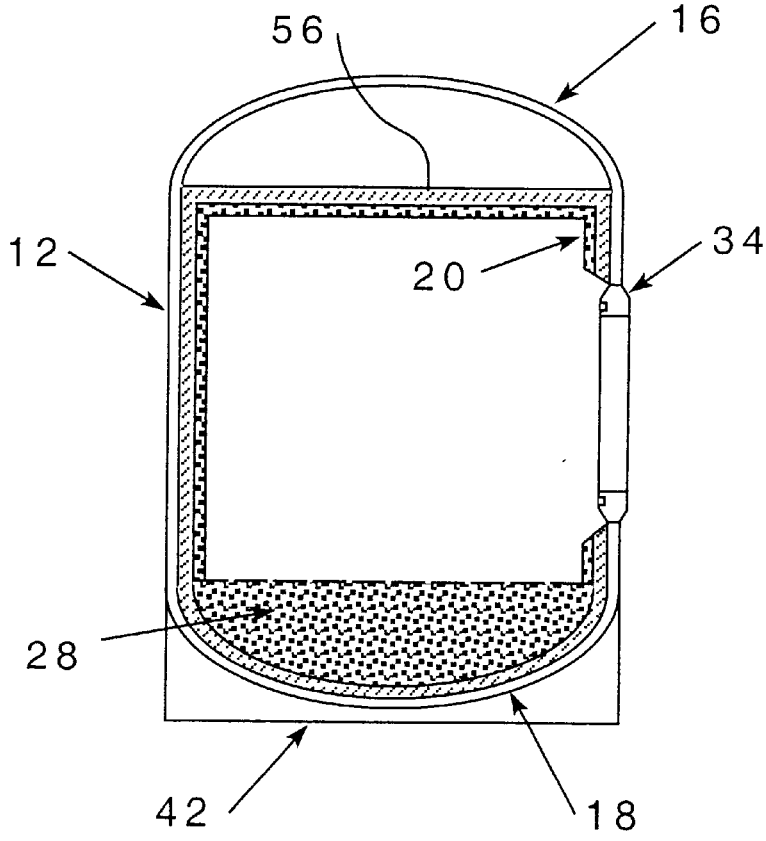
FIG. 12 is a cross-sectional view of the vessel shown in FIG. 1 along line II—II showing features of yet a further embodiment having a layer of insulation.

Referring to FIG. 12, in a still further embodiment of the vessel 10 according to the present invention, a layer of insulation 56 is situated in the gap 22 adjacent the container 12. Preferably, the layer of insulation 56 is a closed cell foam insulation. In this configuration, the sand then fills the remains of the gap 22 between the layer of insulation 56 and the liner 20. During use, the layer of insulation 56 reduces the effects of the blast, the sand mitigates the blast fragment effects, and the container 12 contains the blast and fragments.

Figure 13:
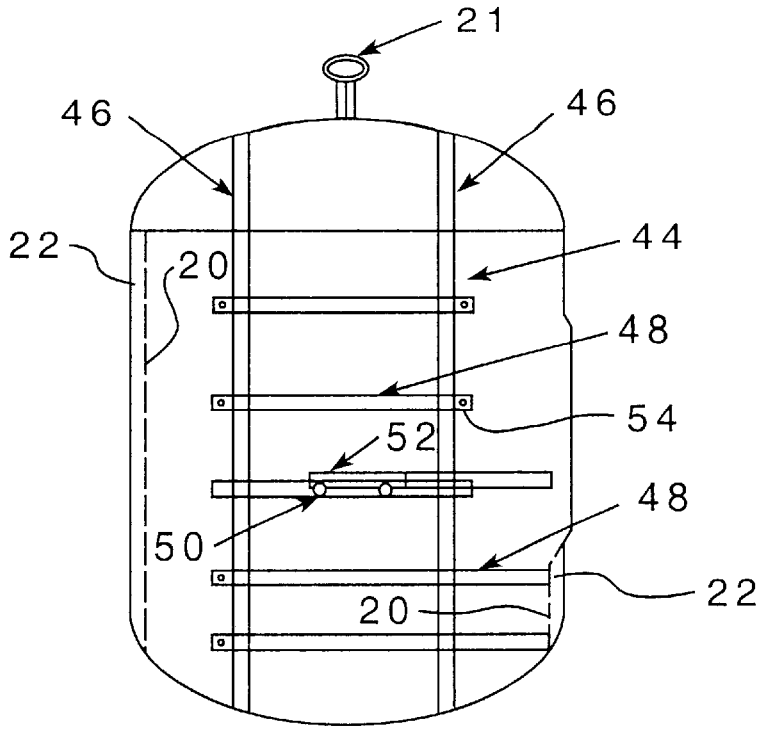
FIG. 13 is a partial cut-away side view of the vessel shown in FIG. 1 showing features of a further embodiment having rails and supporting a carrier.
Figure 14:
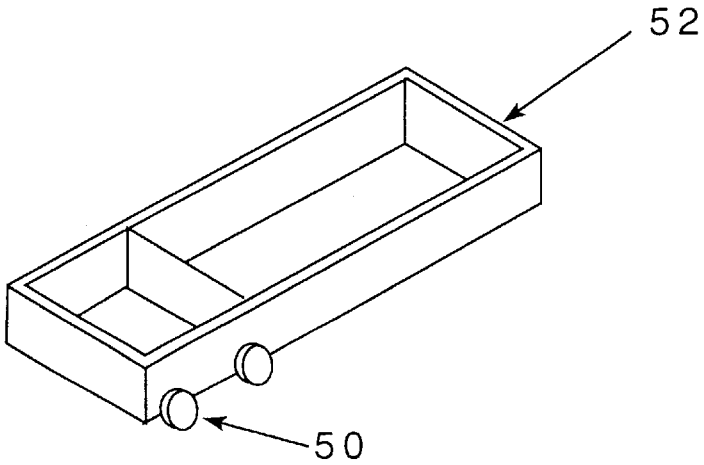
FIG. 14 is a perspective view of the carrier shown in FIG. 13.
Figure 15:
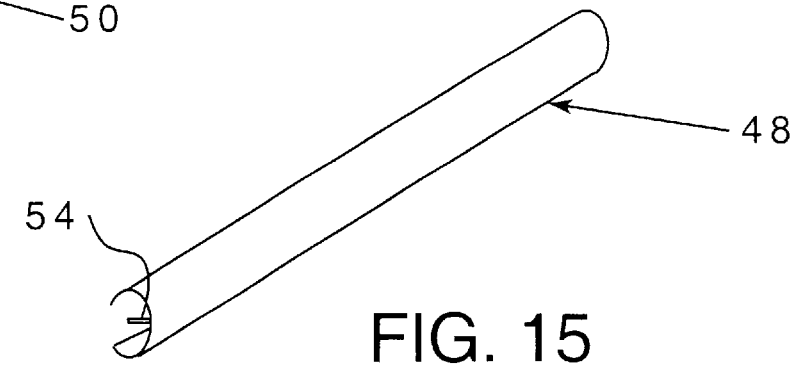
FIG. 15 is a perspective view of one rail shown in FIG. 13.

Referring to FIGS. 13–15 and applicable to any embodiment of the vessel 10, the interior 32 of the vessel 10 may include a rail system 44 attached to the liner 20, for example, by screws. The rail system 44 has vertical rails 46 supporting horizontal rails 48. The horizontal rails 48 are configured to received wheels 50 of at least one carrier 52 thereon. At least one wheel stop 54 may be provided on each horizontal rail 48 to restrict movement of the carrier 52 beyond a predetermined point within the interior 32 of the vessel 10. The carrier 52 may be any shape, for example, rectangular, suitable for moving explosives into and out of the vessel 10. A plurality of carriers 52 may be vertically or horizontally aligned within the interior 32 of the vessel 10 on the rail system 44.

Optional utilities may be added to the vessel 10, such as internal lighting. Ports or openings (not shown) for the utilities should be no more than ½ inch and should be located in the bottom 18 of the container 12, inside the base 42. No other holes in the container 12 for bolts or attachment should be allowed. No rigid connections should be attached to the outside of the vessel 10.

The vessel 10 is designed for storage of explosives and is rated for approximately 10 kg (22 lbs) of TNT explosive and for containment of an explosion at about 24 inches inside the door 30 (i.e., located near the door 30 which is the location considered to be the most vulnerable). The calculated fireball for this charge in open air is approximately 28 feet with a duration of 63 msec. The highest risk area for exposure to thermal hazards is next to the door 30. According to U.S. Department of Defense (DoD) standards, personnel exposure to thermal flux (the measure of the energy flowing through a surface area per second) should be limited to 0.3 cal/cm$^2$-sec.

Shock pressure may leak around the door 30 of the vessel 10. Additionally, pseudo-static pressure that builds up after a confined detonation may leak around the door 30. The at least one vent 19 relieves some of the pseudo-static pressure. Incident pressures should be below 3.5 psi. Observed pressures should be below 2.3 psi for public traffic routes and 1.2 psi for inhabited buildings. (Based on DoD standards. )

No substantial buildup is expected in a room in which the vessel 10 is stored. The preferred embodiment vessel 10, discussed below, takes approximately 3 minutes to vent down through two (2)½ inch vents 19. A typical room should have the same or more area of leakage around doors, windows, and standard ventilation systems.

Direct vent pipes may be provided in the building structure such that the venting is directed outside. The pipes should not be secured to the vessel 10 and should be positioned directly over any vents 19.

A preferred vessel 10 is cylindrical and approximately 8 ft in diameter and 11 ft tall with a 2:1 elliptical top 16 and bottom 18. The door 30 has an 18 inch by 36 inch clear opening. The approximate weight of the vessel 10 with such dimensions is 16,000 lbs.

Testing of the preferred vessel 10 was performed according to the following schedule:

| |
|---|
| Test 1: equivalent to 0.73 lbs TNT |
| Test 2: equivalent to 2.9 lbs TNT |
| Test 3: equivalent to 27.6 lbs TNT, with liner 20 |
| Test 4: equivalent to 27.6 lbs TNT, without liner 20 |

Tests 1 and 2 were used to verify proper function of instrumentation and data acquisition systems. Tests 3 and 4 were "full scale" tests at the charge weight to determine the capability of the vessel 10 to contain the blast, that is the vessel's 10 ability to reduce the overpressure and thermal hazards to an acceptable level for personnel outside the vessel 10. No test included the fragment arresting lining 28 since it is known that 4 inches of sand provide the desired fragment mitigation for the vessel 10.

The testing showed that the vessel 10 experienced very small permanent deformations and the vessel 10 materials experienced a low amount of plasticity.

During the test schedule, the maximum shock pressure at a 5 ft standoff was approximately 0.8 psi. Peak pressures at any standoff measured were below the allowable overpressures of 2.3 psi for public traffic routes and 1.2 psi for an inhabited building.

Little or no fireball escaped through the door 30 of the vessel 10. Additionally, no flying debris or any structural failures were observed.

Temperature changes near the vessel 10 measured at a 9° F. and a 17° F. increase at 5 ft for tests 1 and 2, respectively, and at a 9°F and 3°F increase at 10 ft for Tests 3 and 4, respectively. The rise above the ambient temperature was for a duration of less than 45 msec.

Thermal flux at 5 ft outside the door 30 recorded a peak value of 0.006 cal/cm$^2$-sec for Test 3 and 0.050 cal/cm$^2$-sec for Test 4. Thus, thermal flux at 5 ft did not exceed the personnel limit exposure of 0.3 cal/cm$^2$-sec in either test. No thermal flux was detected at a 10 ft standoff.

The highest percent plastic strain recorded was less than 0.25% for Tests 3 and 4. The highest strain resulted in a ductility of 2.3. Design criteria for the vessel 10 was to limit the response of all structural members to a ductility of 10 or less.

The exit velocity from the steel side wall 14 of the vessel 10 was limited to zero to contain all fragments within the vessel 10.

Based on the testing, a minimum of 5 ft should be maintained as the exclusion zone around the vessel 10 while potentially explosive materials are being stored therein.

Based on the above test schedule, the vessel 10 having no liner 20 or fragment arresting lining 28 could undergo additional exposure(s) to design basis internal detonation(s). However, the condition of the vessel 10 should be inspected and the vessel 10 should be re-certified after each successive internal detonation of non-fragmenting round until measurements indicate a cumulative plastic strain of 3% (a conservative percentage) has been reached or exceeded.

Also based on testing, the vessel 10 having the liner 20 and the fragment arresting lining 28 is not considered a reusable unit because the fragment arresting lining 28 is severely damaged or destroyed in the event of a detonation in the vessel 10 with or without the presence of fragments. In addition to the damaged fragment arresting lining 28, the major structural components could be severely damaged by fragment penetrations. Thus, the vessel 10, under these conditions, is a single use vessel 10.

It will be understood by those skilled in the art that while the foregoing description sets forth in detail preferred embodiments of the present invention, modifications, additions, and changes might be made thereto without departing from the spirit and scope of the invention.

I claim:

1. A vessel for containing an explosion, comprising:

a generally cylindrical container having an elliptical top and an elliptical bottom;

a door providing access to an interior of the vessel; and a door closing system includng:

a pair of first members;

a pair of second members configured to cooperate with the pair of first members; and a center pin configured to cooperate with the pair of second members, wherein the container includes an opening support ring having a groove, the door includes a ridge configured to mate with the groove when the door is in a closed position, and when the door closing system is in an unlocked position and the center pin is actuated, the pair of second members travel lengthwise in relation to the center pin resulting in the pair of first members moving into engagement with the opening support ring to place the door closing system in a locked position.

2. The vessel according to claim 1, wherein:

the groove extends along a top, a bottom, and sides of the opening support ring, and the ridge extends correspondingly along a top, a bottom, and sides of the door.

3. The vessel according to claim 1, wherein the pair of second members each includes:

a stationary member configured to cooperate with the center pin at one end, and a pivot member configured to cooperate with an other end of the stationary member at one end and with one of the pair of first members at an other end.

4. The vessel according to claim 1, further including a base fixedly connected to the vessel and surrounding the bottom.

5. The vessel according to claim 1, further including:

a liner positioned within the container and defining a gap between the liner and the container; and a fragment arresting lining positioned within the gap.

6. The vessel according to claim 5, further including a base fixedly connected to the vessel and surrounding the bottom.

7. The vessel according to claim 5, further including a layer of insulation between the container and the fragment arresting lining.

8. A vessel for storing explosives, comprising:

a generally cylindrical container having a side wall, the side wall having a top rim and a bottom rim;

an elliptical top fixedly connected to the top rim;

an elliptical bottom fixedly connected to the bottom rim and opposed the top;

a door providing access to an interior of the vessel; and a door closing system including:

a pair of first members;

a pair of second members configured to cooperate with the pair of first members; and a center pin configured to cooperate with the pair of second members, wherein the container includes an opening support ring having a groove, the door includes a ridge configured to mate with the groove when the door is in a closed position, and when the door closing system is in an unlocked position and the center pin is actuated, the pair of second members travel lengthwise in relation to the center pin resulting in the pair of first members moving into engagement with the opening support ring to place the door closing system in a locked position.

9. The vessel according to claim 8, wherein:

the groove extends along a top, a bottom, and sides of the opening support ring, and the ridge extends correspondingly along a top, a bottom, and sides of the door.

10. The vessel according to claim 8, wherein the pair of second members each includes:

a stationary member configured to cooperate with the center pin at one end, and a pivot member configured to cooperate with an other end of the stationary member at one end and with one of the pair of first members at an other end.

11. The vessel according to claim 10, further including:

a liner positioned within the container and defining a gap between the liner and the container; and a fragment arresting lining positioned within the gap.

12. The vessel according to claim 10, further including a base fixedly connected to the vessel and surrounding the bottom.

13. The vessel according to claim 10, wherein the door is located on a side of the vessel.

14. The vessel according to claim 10, further including at least one vent hole located in the top.

15. The vessel according to claim 10, wherein the container is steel.

16. The vessel according to claim 11, wherein the liner is metal.

17. The vessel according to claim 11, wherein the fragment arresting lining is sand.

18. The vessel according to claim 10, further including a layer of insulation between the container and the fragment arresting lining.

19. The vessel according to claim 18, wherein the layer of insulation is closed cell foam.

* * * * *